US009254040B2

(12) United States Patent
Foster et al.

(10) Patent No.: US 9,254,040 B2
(45) Date of Patent: Feb. 9, 2016

(54) INVERTED MOTION BASE WITH SUSPENDED SEATING

(71) Applicant: Oceaneering International, Inc., Houston, TX (US)

(72) Inventors: Samuel T. Foster, Perry Hall, MD (US); Stephen F. Fromyer, Silver Spring, MD (US); Eric A. King, Westminster, MD (US); Clifford A. Jennings, Highland, MD (US)

(73) Assignee: OCEANEERING INTERNATIONAL, INC., Houston, TX (US)

( * ) Notice: Subject to any disclaimer, the term of this patent is extended or adjusted under 35 U.S.C. 154(b) by 0 days.

(21) Appl. No.: 14/209,436

(22) Filed: Mar. 13, 2014

(65) Prior Publication Data

US 2014/0259968 A1 Sep. 18, 2014

Related U.S. Application Data

(60) Provisional application No. 61/801,695, filed on Mar. 15, 2013.

(51) Int. Cl.

| | |
|---|---|
| ***A63G 27/04*** | (2006.01) |
| ***A47C 1/12*** | (2006.01) |
| ***A47C 9/06*** | (2006.01) |
| ***E04H 3/30*** | (2006.01) |
| *A63G 1/44* | (2006.01) |

(52) U.S. Cl.
CPC ... *A47C 1/12* (2013.01); *A47C 9/06* (2013.01); *E04H 3/30* (2013.01)

(58) Field of Classification Search
CPC ..... A63G 9/00; A63G 9/08; A63G 9/16; A63G 27/00; A63G 27/02; A63G 27/04; A63G 31/00
USPC ..... 472/39, 44, 45, 46, 47, 130
See application file for complete search history.

(56) References Cited

U.S. PATENT DOCUMENTS

| | | | | |
|---|---|---|---|---|
| 5,188,566 | A * | 2/1993 | Bohme | 472/45 |
| 5,584,697 | A | 12/1996 | Trumbull | |
| 5,803,816 | A * | 9/1998 | Moser et al. | 472/46 |
| 5,941,777 | A * | 8/1999 | Moser et al. | 472/44 |
| 6,354,954 | B1 | 3/2002 | Sumner | |
| 7,967,688 | B2 | 6/2011 | Lai et al. | |
| 8,225,555 | B2 | 7/2012 | Magpuri | |
| 8,474,191 | B2 | 7/2013 | Magpuri | |
| 2009/0209357 | A1 | 8/2009 | Crawford et al. | |

FOREIGN PATENT DOCUMENTS

| | | |
|---|---|---|
| EP | 2517765 A1 | 10/2012 |

* cited by examiner

*Primary Examiner* — Kien Nguyen
(74) *Attorney, Agent, or Firm* — Dentons US LLP

(57) ABSTRACT

An improved inverted motion base with left, right, and rear supports, a carriage to travel along a length of the rear support. The inverted motion base includes a first cable connected to the carriage and wound about a first drum to raise and lower the carriage, and left and right load carrying arms, each connected to a respective left and right ends of a transverse support member. The inverted motion base further includes a second cable connected to the right load carrying arm to raise and lower the right load carrying arm, and a third cable connected to the left load carrying arm to raise and lower the second end of the left load carrying arm. One or more rows of seats are positioned between and suspended from the right and left load carrying arms, each row of seats being parallel to the other row of seats.

20 Claims, 11 Drawing Sheets

128
126
120
210
220
230
112
110
114
116
108
106
200
212
214
216
242

112
124
128
108
114
116
118
120 x
y
z
900
904
906
908
910
912
914
916
918
920
922
924
926
928
930
932
934
936
938
940
942
944
946
948
950
952
954
956
958
960
962
964
966
968
970
972
974
976
978
980
982

INVERTED MOTION BASE WITH SUSPENDED SEATING

This application claims priority to U.S. Provisional App. No. 61/801,695, filed Mar. 15, 2013.

FIELD

The present disclosure relates to theater seating systems. More particularly, to rows of theater seats configured to be loaded with patrons in a loading area and then lifted vertically from the floor of the loading area to a viewing area, where the rows of seats are configured to change their orientation with respect to the floor of the theater in at least roll (left or right side of row at higher elevation than its respective opposite side) and heave (vertical excursions) directions.

BACKGROUND

For thousands of years, theaters have existed for the presentation of live action. A classic example is the Roman Coliseum, construction of which began in 70 AD. Theaters for the presentation of projected movie films (i.e., prerecorded material) are a more modern construction. Purpose built movie theaters (or alternatively buildings, such as stores, modified into movie theaters) probably began their existence in the late 1800 to early 1900's. Today, many types (e.g., digital, 3D, IMAX™, etc.) of movie theaters exist. Both flat and curved screens are used as projection surfaces for the projected movies. Projection onto the screen can come from either the front or back of the screen. Other innovations in projection system technologies have further changed the way that audiences view films. The most unique projection systems often find their way into specialty venues, such as museums and theme parks.

While projection systems have changed, theater seating has largely remained unchanged. Rows of seats, sometimes straight, sometimes curved, face a screen. The rows of seats may be on a flat floor. With flat floor seating, unless the bottom of the projection screen is sufficiently elevated from the floor, an unlucky viewer can have his or her line of sight to the screen obscured by the heads or hats of other patrons seated between the screen and the unlucky viewer. This problem is exacerbated the further the viewer is from the screen. Alternative, the rows of seats may be placed on a sloped or stepped floor. This helps to obviate the above-mentioned problem of obscured views. Nevertheless, most theater seats, whether on a flat, sloped, or stepped floor, are fixed to the floor.

However, fixing seats to the floor limits a viewer's experience to only viewing the motion on the screen. Therefore, even if a viewer is facing an immense screen, the viewer can only imagine the physical sensation of dropping, climbing, or tipping when the corresponding action appears on the screen.

U.S. Pat. No. 6,354,954 (the '954 patent) seeks to add some sensation of physical motion to a patron's theater experience. However, the structure described in the '954 patent can cause a patron to have an adverse reaction. The complex mechanical design of the seat hangers results in the real, not imagined, reduction in the spacing between each pair of rows of seats. The forward movement of the seats as they are being lifted may remind, intentionally, a patron that he is being immersed into a fantasy of taking off and flying in a hang glider, however, the mechanical construction may adversely give the patron a feeling that he is about to crash into the hang glider (row of seats) in front of him. Additionally, although the '954 patent provides for the pitch (nose-up/nose-down) motion of each row of seats, many patrons become afraid that they will pitch forward too much and slip from their seats. Additionally, passengers are loaded onto the rows of seats of the '954 patent from a loading position on a flat floor. The complex mechanical structure of the '954 patent apparatus makes it impossible to provide a "pre-take-off" movie experience to patrons as all but the first row of patrons will have an unobstructed view facing forward. Even their view is obstructed above by the overhanging "glider wing."

U.S. Pat. No. 8,225,555 (the '555 patent) also seeks to add some sensation of physical motion to a patron's theater experience. Like the '954 patent, the rows of seats of the '555 patent are positioned one behind the other on a flat floor. The '555 patent purports to teach the desirability of having a pre-show to entertain patrons as they wait for the main show. Indeed, the '555 patent's concept is to fool the audience into believing that the preshow is the main event. Regardless of its purpose, the '555 patent concept has the same limitations faced by prior art theaters with rows of seats all positioned on the same level on a single flat floor. Namely, viewers that are unlucky enough to sit behind a taller person will have their view of the screen obscured by the taller person's head or hat. Of course, the '555 patent's ultimate "ride" for the patrons is to lift them vertically up from the floor of the preview theater into the central space of the main theater. The patrons then hang from cables in their rows of seats to watch the main presentation.

SUMMARY

Accordingly, embodiments of the present invention are directed to a system, apparatus, and method that substantially obviate one or more of the problems of the related art.

In accordance with the purpose of the invention, as embodied and broadly described herein, an inverted motion base includes left and right vertical supports, spaced apart from each other; at least one rear vertical support; a carriage to travel vertically along a length of the rear support and to resist lateral forces; a first cable connected at a first end to the carriage, the first cable having a second end wound about a first rotatable drum, wherein the first cable in combination with the first rotatable drum raises and lowers the carriage; a knuckle protruding from the carriage; a transverse support member pivotably coupled to the knuckle; left and right load carrying arms, each connected at a first end to a respective left and right ends of the transverse support member; a second cable connected at a first end to a second end of the right load carrying arm, the second cable having a second end wound about a second rotatable drum, wherein the second cable in combination with the second rotatable drum raises and lowers the second end of the right load carrying arm; a third cable connected at a first end to a second end of the left load carrying arm, the third cable having a second end wound about a third rotatable drum, wherein the third cable in combination with the third rotatable drum raises and lowers the second end of the left load carrying arm; and one or more rows of seats, each row of seats positioned between and suspended from the right and left load carrying arms, each row of seats being parallel to the other row of seats.

Further, as embodied and broadly described herein, a method of entertainment implemented with an inverted motion base comprises positioning at least two rows of seats facing the same direction, a first row in front of a second row, the first row at a first height measured from a predetermined fixed point and the second row at a second height measured from the predetermined fixed point, where the second height is greater than the first height; and elevating the first and second rows to third and fourth heights, respectively, where the third height is greater than the second height and the fourth height are less than the third height.

Also, as embodied and broadly described herein, an inverted motion base includes left and right rear vertical supports, spaced apart from each other; a central rear vertical support; a front vertical support; a horizontal support connector coupling the central rear vertical support with the front vertical support; a carriage to travel vertically along a length of the central rear vertical support and to resist lateral forces; a slew bearing protruding from the carriage; a transverse support member pivotably coupled to the slew bearing via an articulated pivot element; a roof coupled to the transverse support member; one or more rows of seats, each row of seats suspended from the roof, each row of seats being parallel to the other row of seats; a first cable connected at a first end to a forward edge mid-point of the roof, the first cable having a second end wound about a first rotatable drum, wherein the first cable in combination with the first rotatable drum raises and lowers the front of the roof; a second cable connected at a first end to a right end of the transverse support member, the second cable having a second end wound about a second rotatable drum, wherein the second cable in combination with the second rotatable drum raises and lowers the right end of the transverse support member; and a third cable connected at a first end to a left end of the transverse support member, the third cable having a second end wound about a third rotatable drum, wherein the third cable in combination with the third rotatable drum raises and lowers the left end of the transverse support member, wherein the combination of the second and third cable raise and lower the carriage.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION

Reference will now be made in detail to the exemplary embodiments of the present invention, which are illustrated in the accompanying drawings.

Figure 1:
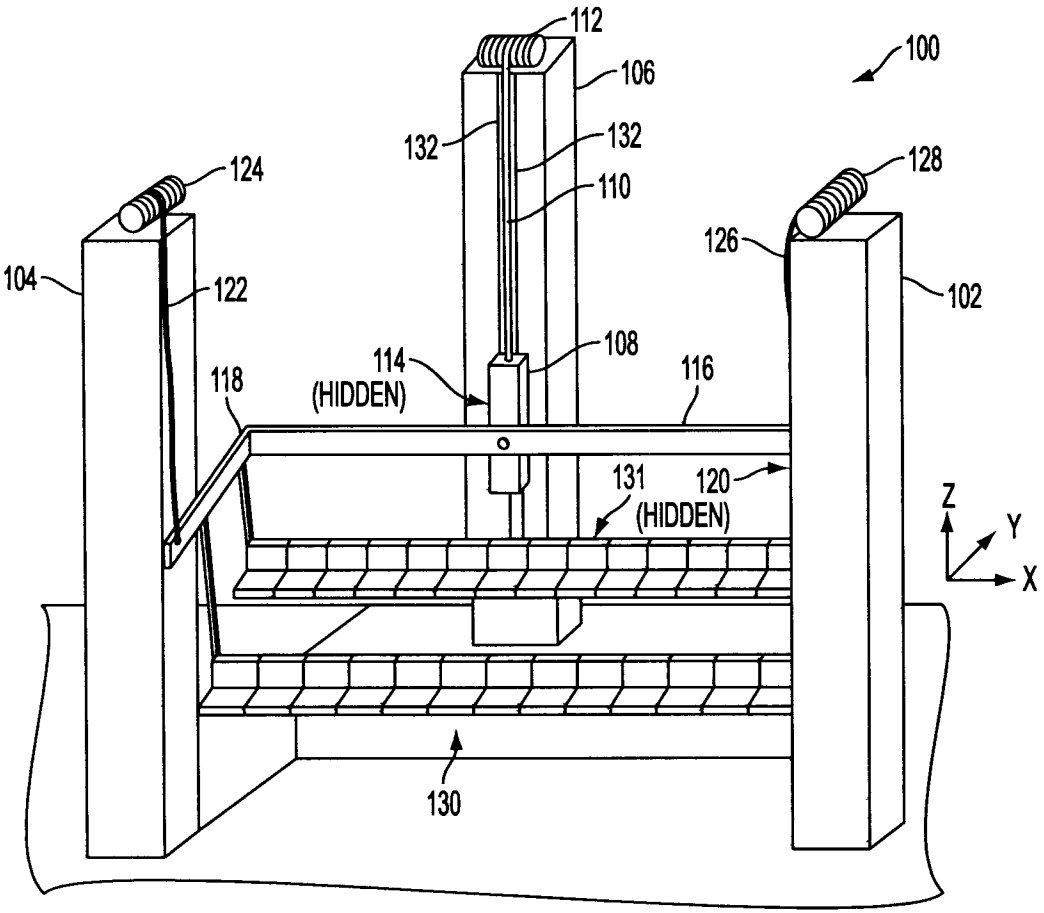
FIG. 1 is an isometric front view of an inverted motion base with suspended seating in accordance with an embodiment of the invention.

FIG. 1 is an isometric front view of an inverted motion base with suspended seating in accordance with an embodiment of the invention. In this exemplary embodiment, an inverted motion base 100 includes a left vertical support 102 and a right vertical support 104. The vertical supports 102, 104 are spaced apart from each other. Inverted motion base 100 further includes at least one rear vertical support 106. A carriage 108 is configured to travel vertically along a length of the rear support 106. Carriage 108 may be configured to resist lateral forces (i.e., left-right forces along the X axis). Such lateral resistance may be accomplished by, for example, the carriage 108 being set in a groove, rail, or cutout, or by strategically spaced limit blocks.

A first cable 110 may be connected at a first end to carriage 108. A second end of the cable 110 may be wound about a first rotatable drum (or winch) 112. The first cable 110 in connection with first drum 112 are configured to raise and lower carriage 108. Other devices can be used to raise and lower the carriage. For example, a worm drive comprising a screw component with an axis of rotation parallel to the vertical axis of rear support 106 meshing with corresponding worm gear teeth in the vertical surface of carriage 108. Alternatively, a pneumatic or electric lifting device could be mounted below carriage 108. Extension and retraction of the lifting device could raise and lower, respectively, carriage 108.

A knuckle 114 (see FIGS. 2A-2C, 3A, and 3B) may protrude from the carriage. The knuckle would extend away from the carriage, toward a plane formed between the left and right vertical supports 102, 104.

A transverse support member 116 may be coupled to knuckle 114, transverse support member 116 may be configured to pivot with respect to knuckle 114 about an axis that is perpendicular to a plane formed between the left and right vertical supports 102, 104. Transverse support member 116 may also be configured to pivot with respect to knuckle 114 about an axis that is parallel to the plane formed between the left and right vertical supports 102, 104.

The inverted motion base 100 further includes a left load carrying arm 120 (see FIGS. 2A-2C, 3A, and 3B) and a right load carrying arm 118. Each load carrying arm 120, 118 is connected at one end to a respective left and right end of transverse support member 116.

Figure 5:
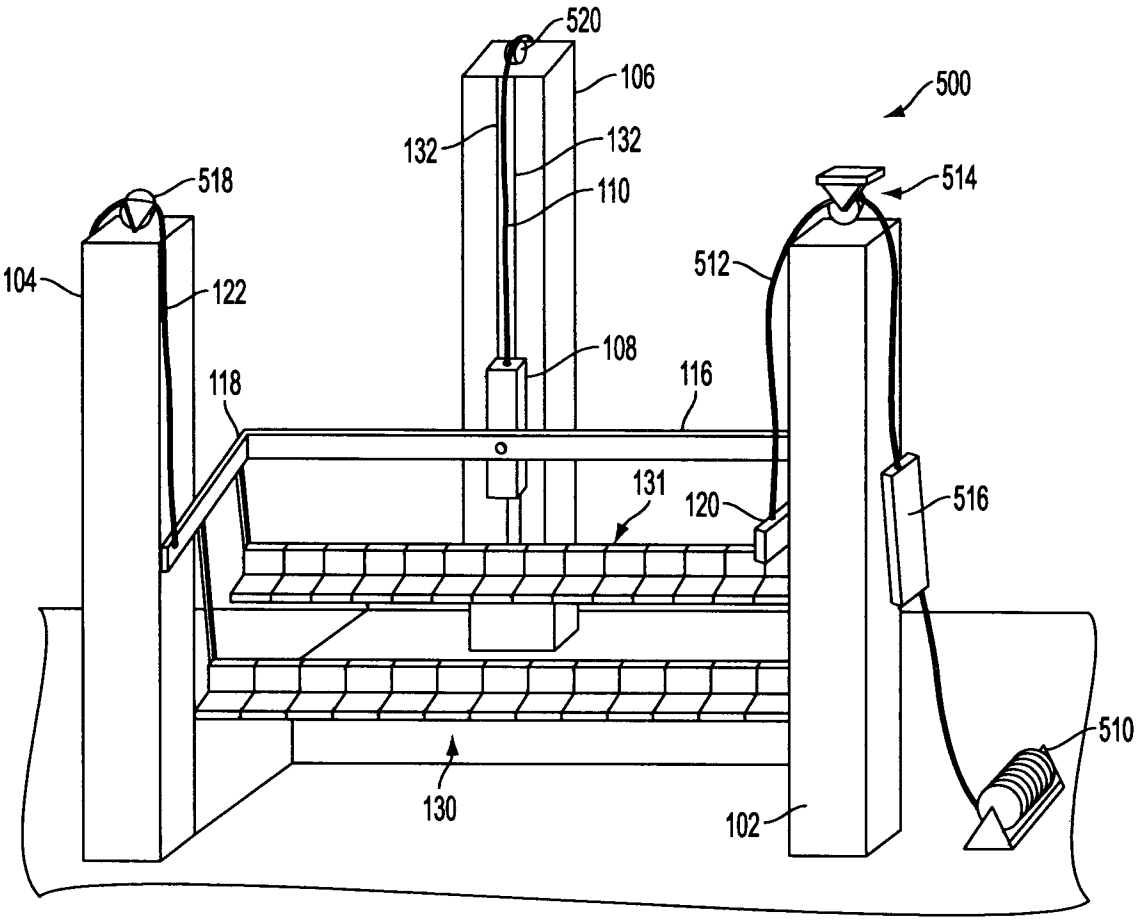
FIG. 5 is an isometric front view of an inverted motion base with suspended seating in accordance with another embodiment of the invention.
Figure 6:
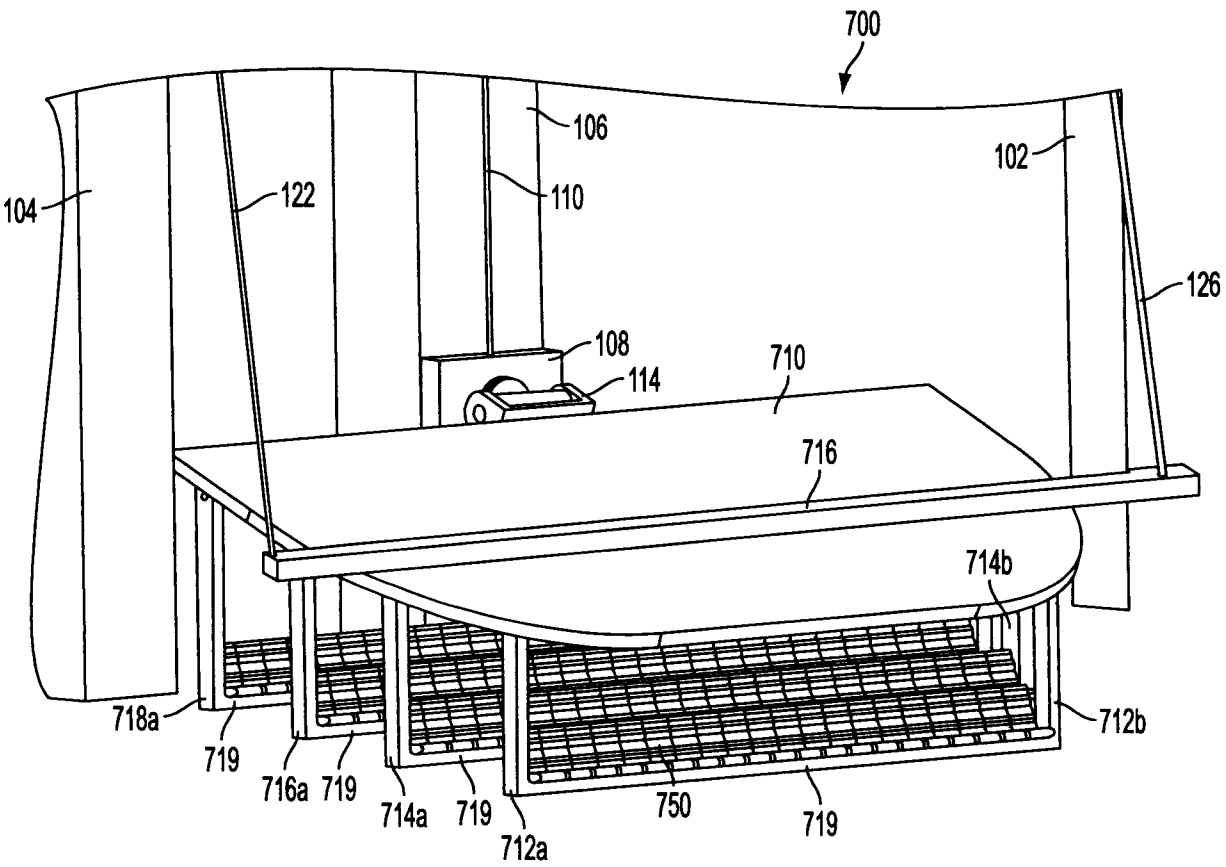
FIG. 6 is an alternate embodiment of an inverted motion base, similar to the embodiments of FIG. 1 and FIG. 5.

The inverted motion base 100 may further include a roof (not shown in FIGS. 1 and 5 for clarity reasons) as illustrated in FIGS. 6 and 7. The roof, in addition to providing structural support to the inverted motion base 100, provides a false illusion of scale to the facility in which the inverted motion base 100 is installed.

A second cable 122 may be connected at a first end to a proximal end of the right load carrying arm 118. The cable's 122 second end may be wound about a second rotatable drum (or winch) 124. The second cable 122 in connection with second drum 124 may be configured to raise and lower the proximal end of the right load carrying arm 118.

A third cable 126 may be connected at a first end to a proximal end of the left load carrying arm 120. The cable's 126 second end may be wound about a third rotatable drum (or winch) 128. The third cable 126 in connection with third drum 128 may be configured to raise and lower the proximal end of the left load carrying arm 120. The inverted motion base 100 also includes at least two rows of seats 130, 131 (FIG. 1), although one row of seats is also contemplated by this disclosure. As illustrated, each row of seats is positioned between and suspended from the left and right load carrying arms 120, 118. Each row of seats may be parallel to the other row of seats 130, 131.

In one embodiment, the left, right, and rear vertical supports 102, 104, and 106, respectively, are vertical columns. The vertical columns may be made of steel or reinforced concrete, or equivalent load bearing material. In one embodiment, the left, right, and rear vertical supports 102, 104, 106 are fabricated from structural steel. In another embodiment, the left, right, and rear vertical supports 102, 104, 106 are realized from the walls of a structure housing the inverted motion base 100.

In this embodiment, the rotatable drums (winches) 112, 128, 124 are mounted atop the rear, left, and right vertical supports 106, 102, 104. In an alternative embodiment, the rotatable drums (winches) 112, 128, 124 may be mounted within the facility ceiling.

As shown in FIG. 1, the carriage 108 may roll on wheels (not shown) on a track 132 fixed to rear vertical support 106. To prevent lateral movement, the wheels may have features on them that will allow them to roll along the track, but prevent them from coming off of the track. Such an embodiment helps prevent lateral movement of the carriage 108.

The description of the components of the inverted motion base 100 as provided with reference to FIG. 1 is applicable to at least FIGS. 2A-2C, 3A, and 3B. Accordingly, said description will not be repeated.

Figures 2A, 2B, 2C:
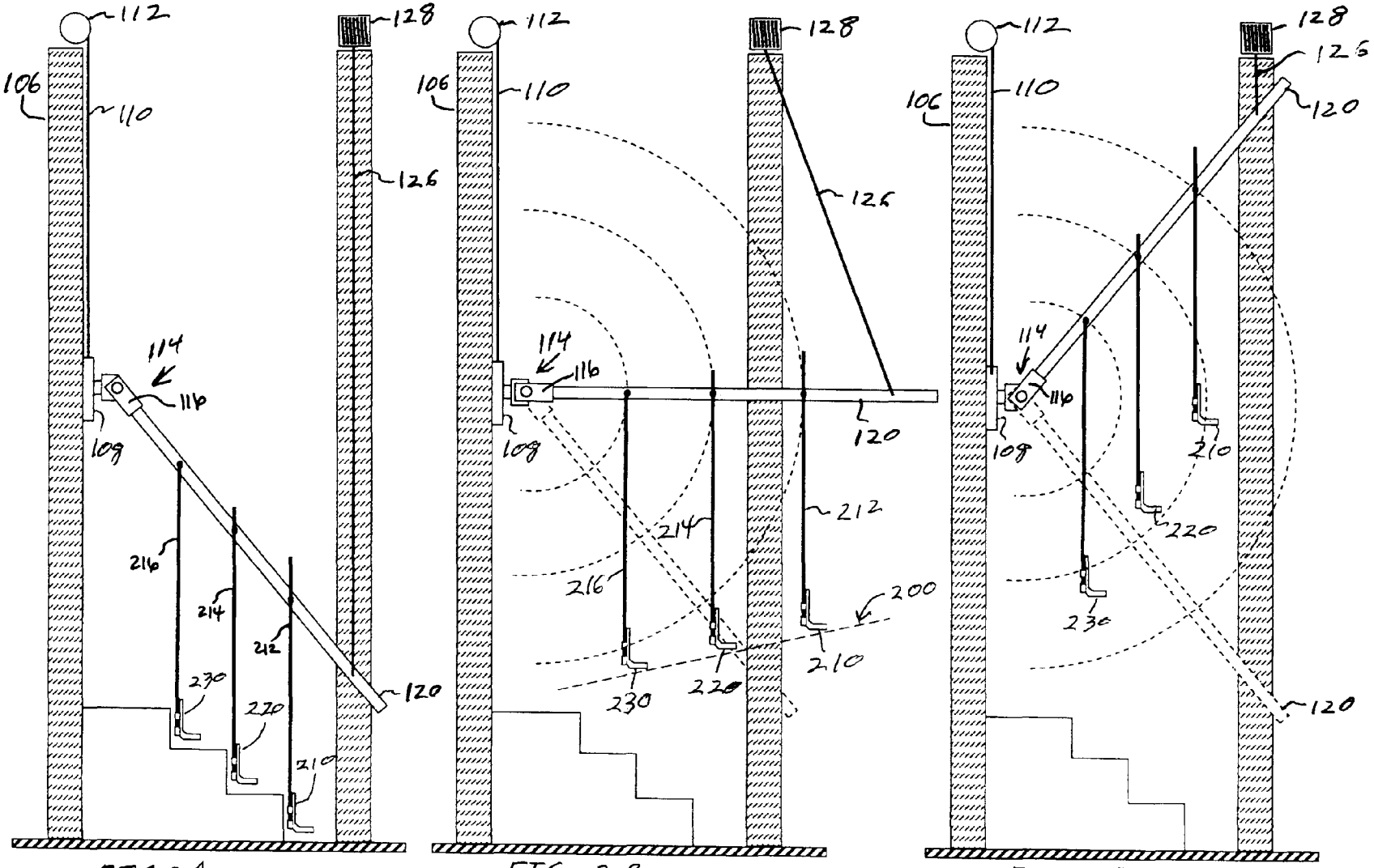
FIG. 2A illustrates an inverted motion base in a passenger loading configuration in accordance with an embodiment of the invention.
FIG. 2B illustrates the apparatus of FIG. 2A at the midpoint of the elevation of the suspended seating in accordance with an embodiment of the invention.
FIG. 2C illustrates the inverted motion base in a passenger viewing configuration in accordance with an embodiment of the invention.

FIG. 2A illustrates an inverted motion base in a passenger loading configuration in accordance with an embodiment of the invention. FIG. 2B illustrates the apparatus of FIG. 2A at the midpoint of the elevation of the suspended seating in accordance with an embodiment of the invention. FIG. 2C illustrates the inverted motion base in a passenger viewing configuration in accordance with an embodiment of the invention.

One configuration of a facility in which inverted motion base 100 is used is illustrated in FIGS. 2A-2C, 3A, and 3B. In a preferred embodiment, inverted motion base 100 is used in a facility that offers "stadium style seating" (i.e., seating in which each row of seats is higher than the preceding row, as a patron walks from the front to the back of the facility). Stadium style seating offers patrons the advantage of better visibility (i.e., line of sight) of a projection screen that may be positioned at the front of the facility. With stadium style seating, patrons can enjoy an unobstructed view of the projection screen. Additionally, stadium style seating permits facility operators to divide groups of patrons into smaller groups. Each small group of patrons is able to enter the facility using a door specifically marked for their "floor". That is, one or more rows of seats may be associated with a floor, and patrons in those rows can enter the facility using a door proximate the associated row(s).

FIG. 2A illustrates this type of seating. Each row of seats 210, 220, 230 are connected to the left and right load carrying arms 120, 118 from above by respective suspension arms 212, 214, 216, which in one embodiment may be cables.

Further, many facilities now present patrons with a pre-show before the patrons are presented with the main show. By use of the preferred embodiment, where patrons are loaded into the rows of an attraction while the rows are not on the same floor, a facility operator can present a pre-show to the patrons (as a whole or in smaller groups) with all of the convenience of a modern movie theater.

FIG. 2B illustrates the motion of the rows of seats 210, 220, 230 as the left and right load carrying arms 120, 118 rotate upward to a horizontal position. A unique feature of the embodiments of the invention described herein is an enhanced vertical separation distance between rows when the rows are in a viewing or action state. The enhanced vertical separation is achieved by using shorter lengths of suspension arms 212, 214, 216 for each subsequently forward row of seats. As illustrated, arm 212 is shorter than arm 214, which is shorter than arm 216. Using shorter arms for the most forward row means that when the left and right load carrying arms 120, 118 rotate to their final elevation angle (see FIG. 2C), the most forward row will achieve a higher elevation than the second and third rows in comparison to the elevation it would have received had all arms 212, 214, 216 been the same length.

Thus, embodiments described herein achieve greater vertical separation between rows, when compared to systems using fixed distances from a hanger point to the top of a seat for every row, by suspending each row of seats 210, 220, 230 from the left and right load carrying arms 120, 118 by suspension arms of fixed length, wherein the fixed length of each succeeding row, from the back of the load carrying arms to the front of the load carrying arms, is shorter than the preceding row. Dashed and angled line 200 shown in FIG. 2B illustrates the degree of shortening used.

FIG. 2B also illustrates that as the rows of seats are lifted from their loading positions, the distance between the rows of seats increases to a maximum horizontal separation that is achieved when the load carrying arms are horizontal. As the load carrying arms are raised (rotated) to their maximum elevation (see FIG. 2C), the distance between the rows of seats decreases back to their original distances of separation (see FIG. 2A). Thus, in the embodiments described herein, because the arms 212, 214, 216 from which the rows of seats 210, 220, 230 are suspended are attached to the load carrying arms 118, 120, and because the load carrying arms 118, 120 rotate about the knuckle 114 on the axis of the transverse support member 116, the arm attachment points trace a circle through space that is centered on the axis of transverse support member 116 (see FIGS. 2B and 2C). Therefore, the separation distance between adjacent rows of seats during loading operations is greater than or equal to the separation distance between adjacent rows of seats during viewing operations if the maximum angle of declination of the load carrying arms 118, 120 in the loading position (see FIG. 2A) is less than or equal to the maximum angle of inclination of the load carrying arms 118, 120 in the viewing position (see FIG. 2C).

Figure 3B:
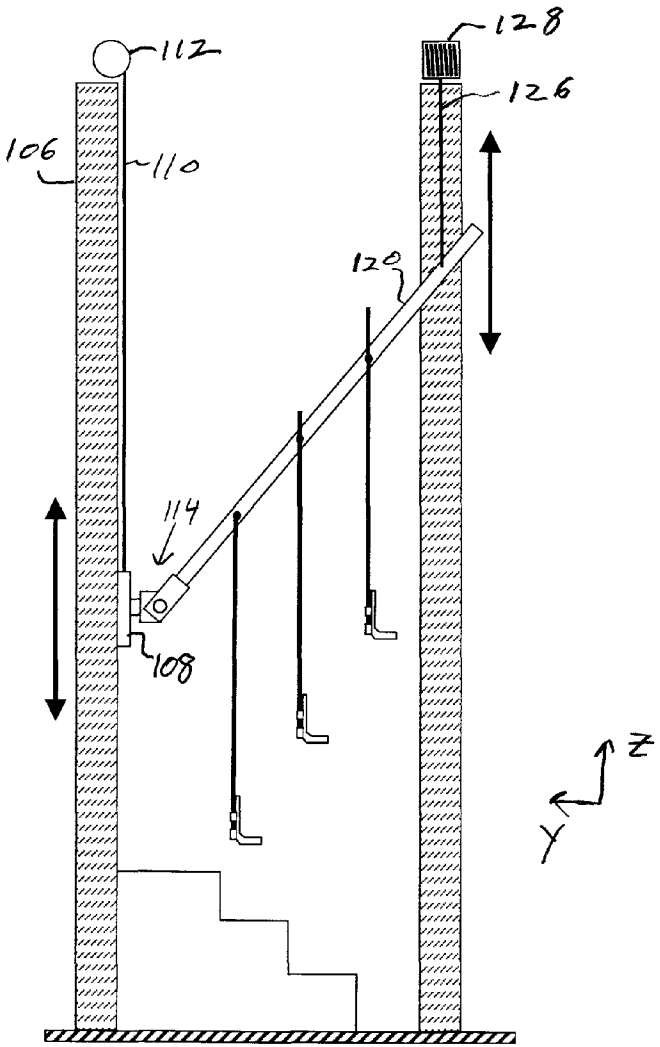
FIGS. 3A and 3B illustrate an ability to execute a heave motion (vertical excursion) in accordance with an embodiment of the invention.
Figure 3A:
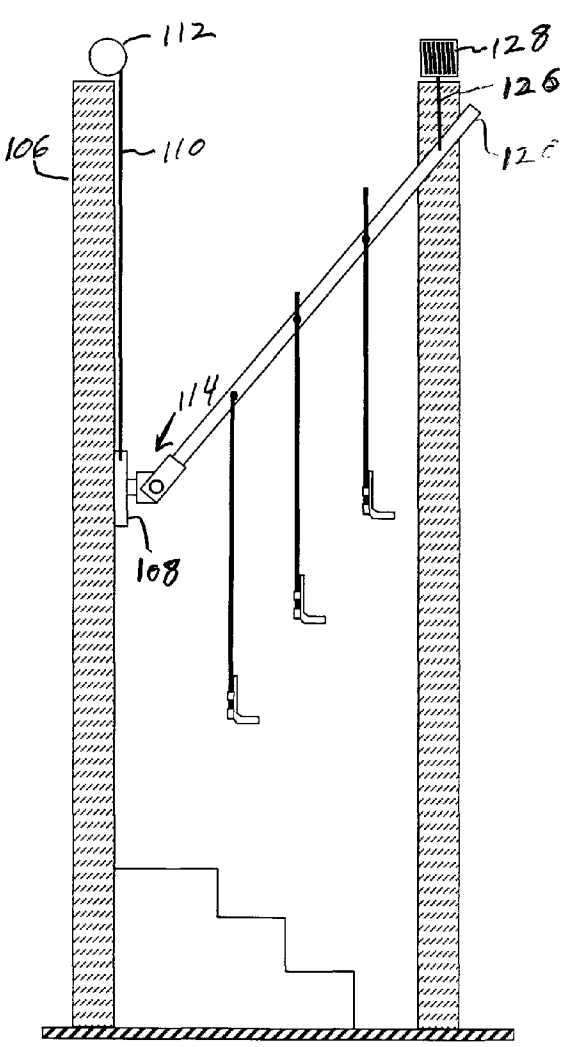

FIGS. 3A and 3B illustrate an ability to execute a heave motion (i.e., vertical excursion) in accordance with an embodiment of the invention. The unique configuration of the embodiments described herein permits the angle of load carrying arms 118, 120 to remain constant while the overall elevation of the arms is changed.

If all rotatable drums 112, 124, 128 are the same diameter, a heave motion can be achieved by simultaneously rotating all three drums 112, 124, 128 in the same direction at the same rate. From the starting position in FIG. 3A, the entire motion base can be dropped to a lesser height. Then, as shown by the double headed arrows in FIG. 3B, the entire motion base can be moved upward and/or downward. A straightforward calculation can determine the amount of linear vertical travel for a given degree of rotation of a drum of a given diameter. Thus, identical heave action can be felt by all patrons even if the drums 112, 124, 128 are of different diameters (or different effective diameters due to the amount of cable rolled onto one drum compared to the next).

Figures 4A, 4B, 4C, 4D:
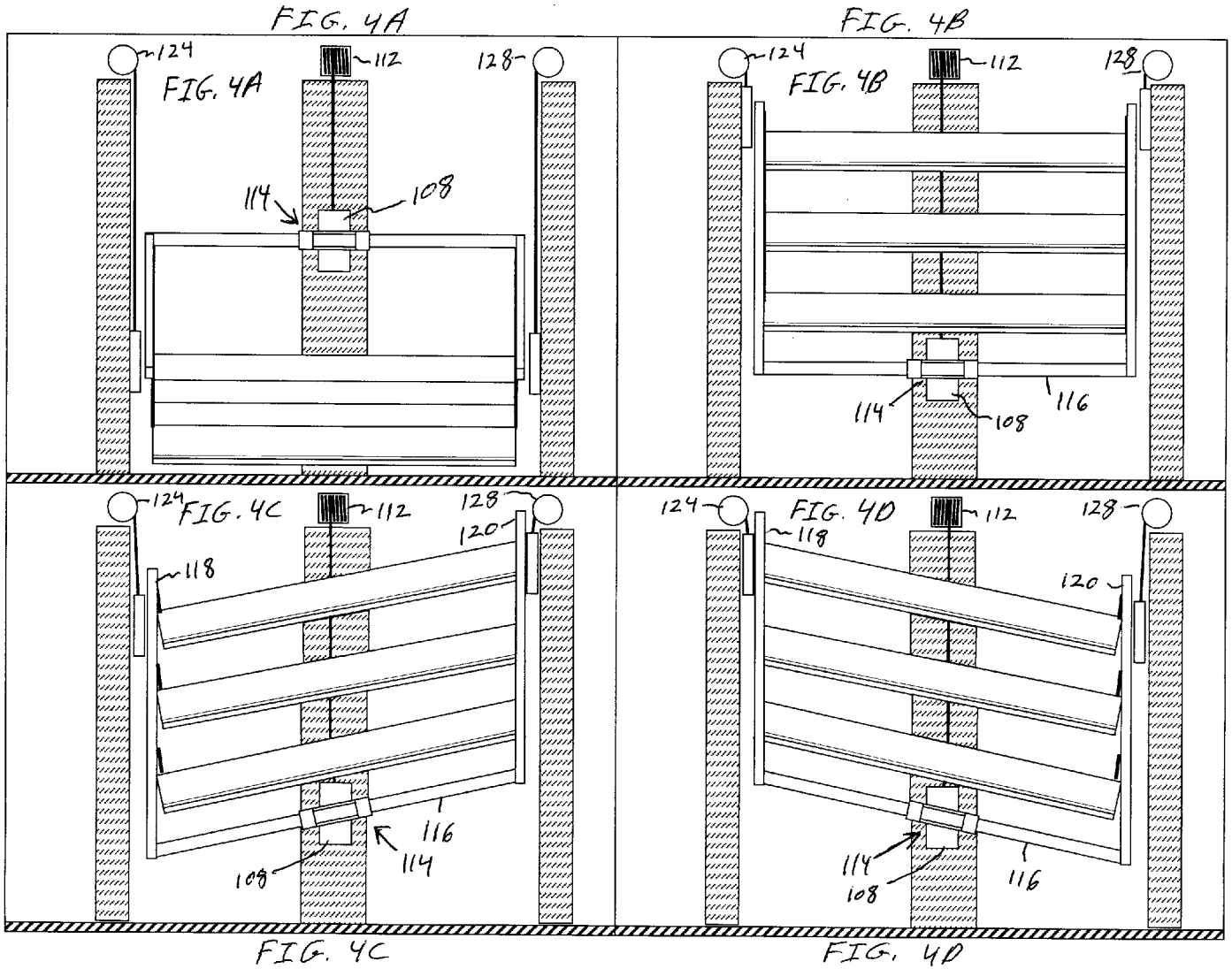
FIGS. 4A-4D are front views of an inverted motion base with suspended seating in various orientations in accordance with an embodiment of the invention.

FIGS. 4A-4D are front views of an inverted motion base 100 with suspended seating in various orientations in accordance with an embodiment of the invention. In FIG. 4A, the rows of seats of the inverted motion base 100 are in a loading position (as in FIG. 2A). In FIG. 4B, the rows of seats of the inverted motion base 100 are raised to a viewing or intermediate level. In FIG. 4C, a second end of the left load carrying arm 120 is elevated while the proximal end of the right load carrying arm 118 is lowered. This causes transverse member 116 to rotate about knuckle 114. This combination of movements allows the patrons in all rows of seats to experience a roll to the right. FIG. 4D illustrates patrons experiencing a roll to the left.

FIG. 5 is an isometric front view of an inverted motion base 500 with suspended seating in accordance with another embodiment of the invention. With the exception of an alternative configuration of lifting mechanisms, which will be described below, all of the components of FIG. 5 have already been described in connection with FIG. 1. Therefore, their descriptions will not be repeated here. In this embodiment, the rotatable drums (winches) of FIG. 1 mounted atop the left, right, and rear vertical supports 102, 104, 106 have been replaced with a lifting system that may be more efficient. Specifically, drum winches 112, 124, 128 are replaced by three systems of floor mounted winches, counterweights, and flagging sheaves. To maintain clarity in the FIG. 5 illustration, only vertical support 102 will be illustrated with the full complement of equipment, however similar components are associated with each of vertical supports 104, 106.

According to the embodiment shown in FIG. 5, a winch (or rotatable drum) 510 is mounted on the ground (or floor), near the base of vertical support 102. A cable 512 runs from a load carrying arm 120 up to a pulley 514 (e.g., flagging sheave) which is mounted atop vertical support 102. A flagging sheave type pulley 514 is useful in this application as cable 512 tends to be pulled toward the front of the facility when load carrying arms 118, 120 are in a horizontal position and toward the back of the facility when load carrying arms 118, 120 are in the loading or viewing orientations. The axis of pulley 514 can be oriented such that it will pivot in the direction to which the cable is being pulled. This prevents the cable 512 from jumping from the groove of the pulley 514 in the sheave and becoming entangled in the supporting structure. Cable 512 passes through pulley 514 and downward toward a counterweight 516. By balancing the weight of the inverted motion base 500 with the weight of counterweight 516, the horsepower of winch 510 can be reduced in comparison to that of the rotatable drum (winch) 128 in FIG. 1, providing additional benefit to this embodiment. Flagging sheaves 518 and 520 are shown on right vertical support 104 and rear vertical support 106, respectively.

FIG. 6 is an inverted motion base 700 with suspended seating in accordance with another embodiment of the invention, similar to FIGS. 1 and 5. With the exception of an alternative configuration of lifting structure and seating supports, which will be described below, all of the components of FIG. 6 have already been described in connection with FIG. 1. Therefore, their descriptions will not be repeated here. In this embodiment, a roof 710 is coupled to the knuckle 114 and substantially covers the patron seating area. A transverse support member 716 is coupled to the roof 710 at a location forward of the knuckle 114 (preferably, on the front half of the roof 710 structure) and is connected on its right end to the second cable 122 and on its left end to the third cable 126. The illustration of FIG. 6 does not show the top of vertical supports 102, 104, 106 and the associated rotatable drums or pulleys depending on the embodiment. The structure formed by the coupled roof 710 and transverse support member 716 is rotated about the knuckle 114 by the cables 122 and 126.

Figure 7B:
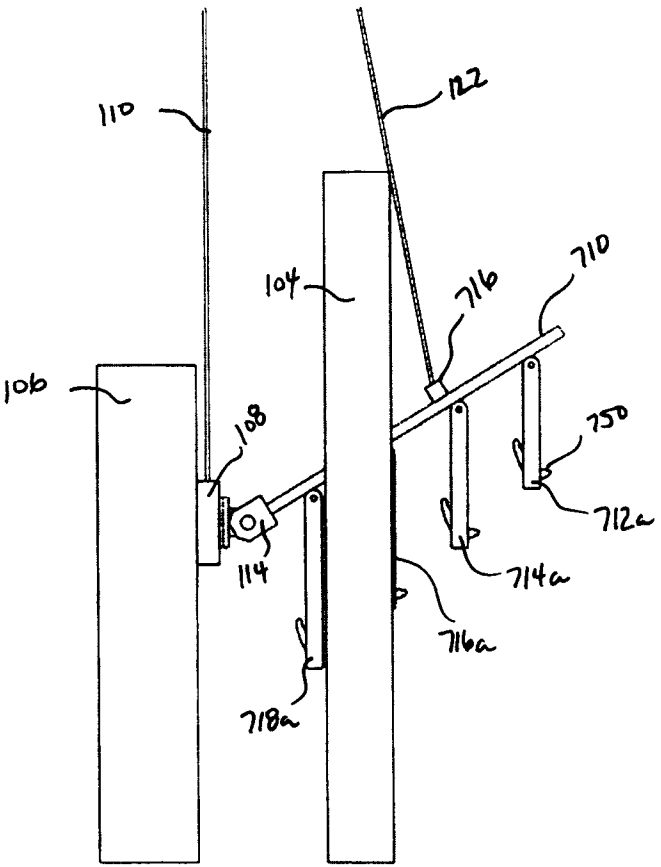
FIG. 7B illustrates the alternate embodiment shown in FIG. 6 in a passenger viewing configuration.
Figure 7A:
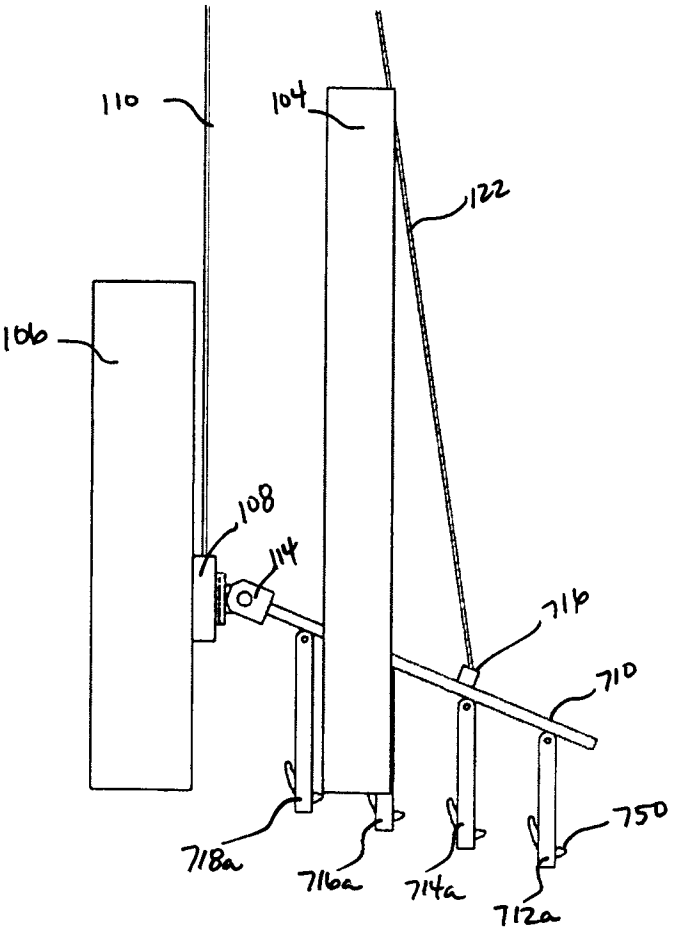
FIG. 7A illustrates the alternate embodiment shown in FIG. 6 in a passenger loading configuration.

The inverted motion base 700 also includes four rows of seats 750. As illustrated, each row of seats is positioned between and suspended from suspension supports 712*a*, 712*b*, 714*a*, 714*b*, 716*a*, 716*b*, 718*a*, 718*b*. Enhanced vertical separation is achieved by using shorter lengths of suspension supports 712, 714, 716, 718 as shown in FIGS. 7A and 7B for each subsequently forward row of seats. As illustrated, suspension support 712 is shorter than support 714, which is shorter than support 716, which is shorter than support 718. Using shorter supports for the most forward row means that when the roof structure rotates to its final elevation angle (see FIG. 7B), the most forward row will achieve a higher elevation than the second and third rows in comparison to the elevation it would have received had all supports 712, 714, 716, 718 been the same length.

The supports 712, 714, 716, 718 are connected on a first end to the roof 710. Each row of seats may be parallel to the other row of seats. This embodiment also includes a transverse seat support member 719 coupled on each end to a second end of the supports 712, 714, 716, 718 and located underneath and providing support for the respective rows of seats 750. As the structure formed by the coupled roof 710 and transverse support member 716 is rotated about the knuckle 114, the respective rows of seats travel circular paths centered of an axis of the knuckle 114.

FIG. 7A illustrates the inverted motion base 700 in a passenger loading configuration in accordance with an embodiment of the invention. FIG. 7B illustrates the inverted motion base 700 in a passenger viewing configuration in accordance with an embodiment of the invention. The movement of the inverted motion base 700 is identical to that described with reference to FIGS. 2A and 2C and therefore will not be repeated here. The illustrations of FIGS. 7A and 7B do not show the top of vertical supports 102, 104, 106 and the associated rotatable drums or pulleys depending on the embodiment.

Figure 8:
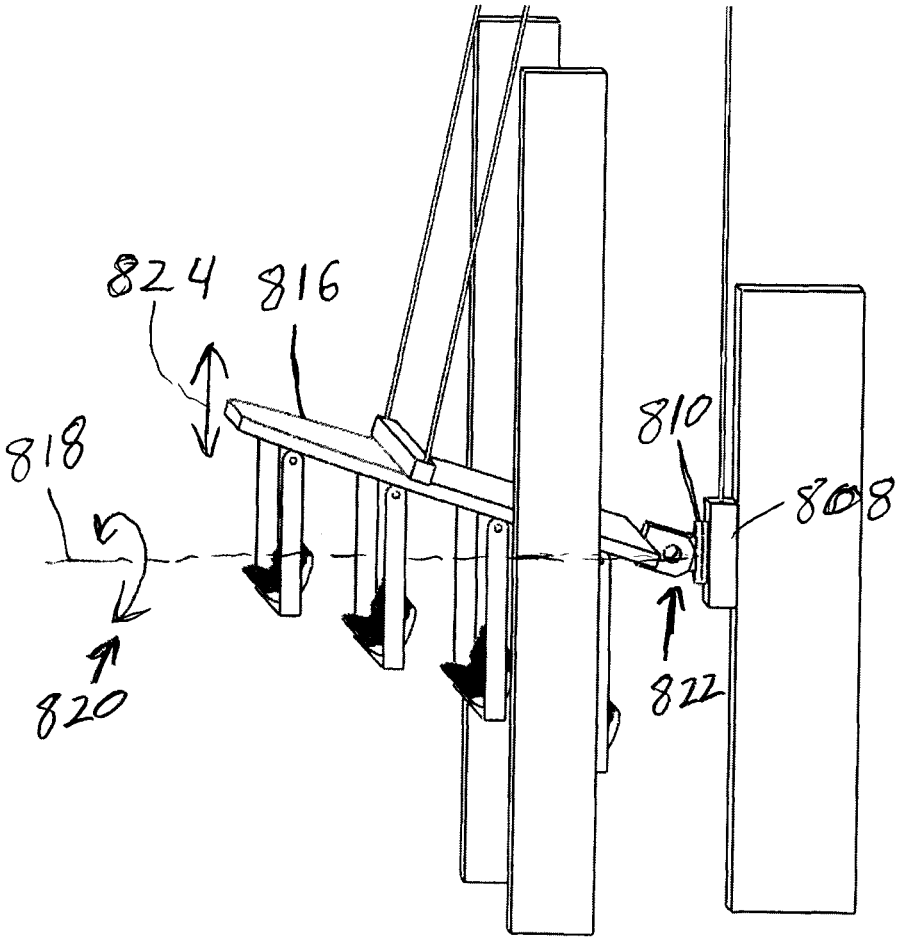
FIG. 8 is an illustration of an inverted motion base with supported seating in accordance with still another embodiment of the invention.

FIG. 8 is an illustration of an inverted motion base with supported seating in accordance with still another embodiment of the invention. The illustration of FIG. 8 does not show the top of vertical supports 102, 104, 106 and the associated rotatable drums or pulleys depending on the embodiment. In the illustration of FIG. 8, the carriage 808 (similar to 108) is coupled to a slew bearing 810 which replaces what has been generally referred to as the "knuckle 114" in this disclosure. Slew bearing 810 permits either transverse member 116 (see FIG. 1) or a rigid support structure 816 to rotate about an axis 818 as shown by arrows 820 in FIG. 8. An articulated pivot 822 couples the slew bearing 810 to the rigid support structure 816. The articulated pivot 822 permits rigid support structure 816 (or, with reference to FIG. 1, the entire rigid frame comprising load carrying arms 118, 120, and transverse member 116) to tilt upward and downward as shown by arrows 824.

Figure 9:
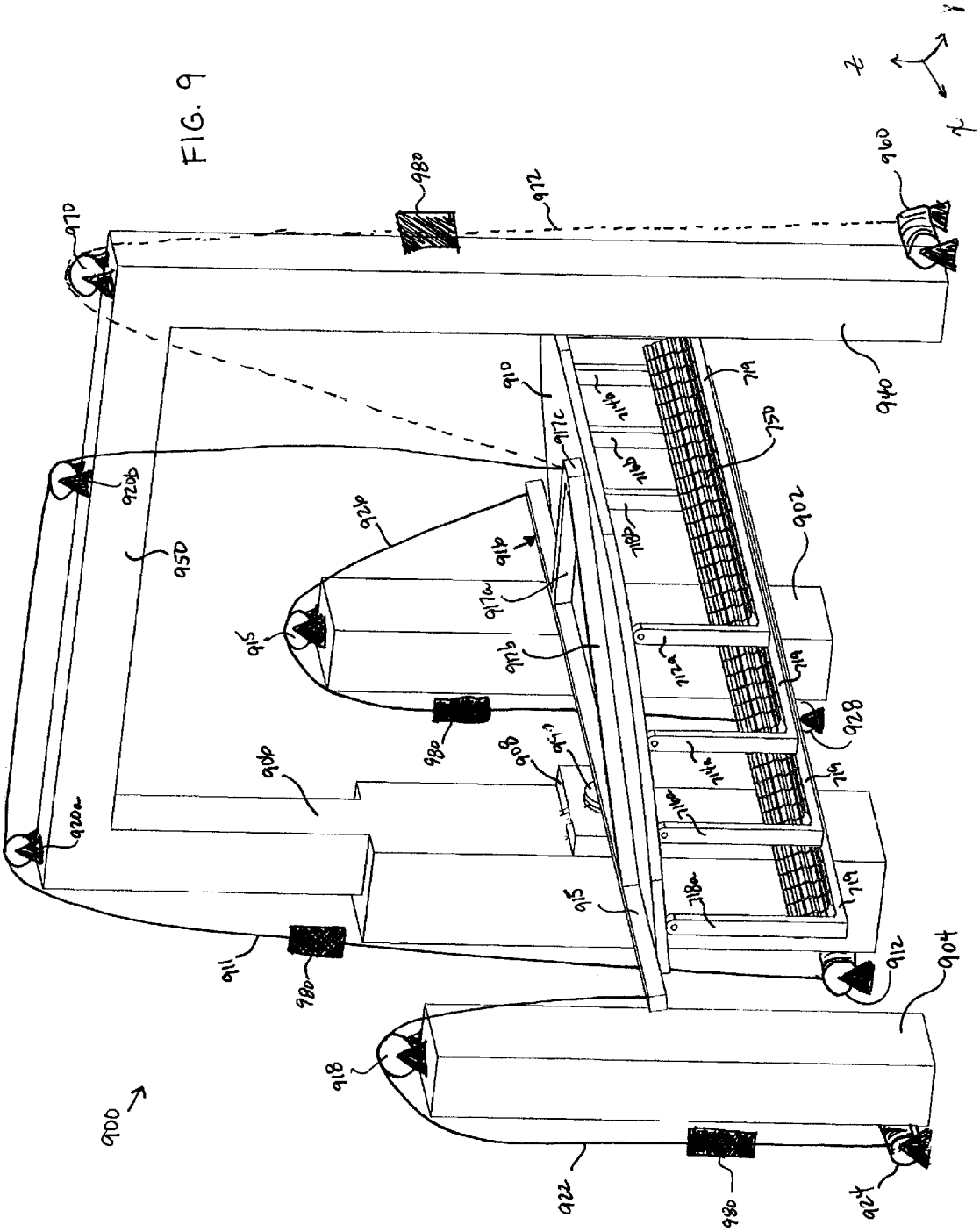
FIG. 9 is an isometric front view of an inverted motion base with suspended seating in accordance with an embodiment of the invention.
Figure 10:
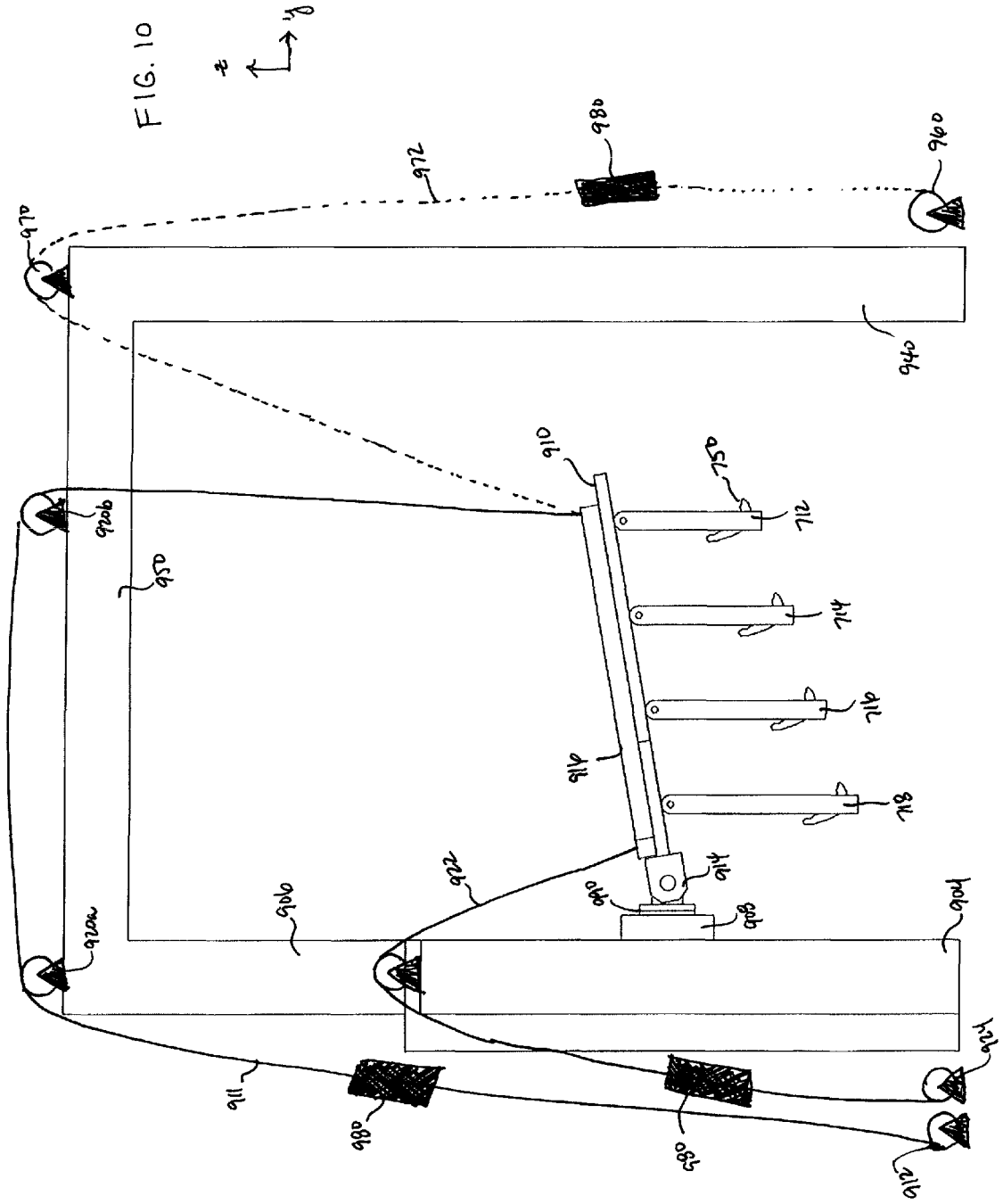
FIG. 10 illustrates the alternate embodiment shown in FIG. 9 in a near midpoint elevation of the suspended seating in accordance with an embodiment of the invention.
Figure 11:
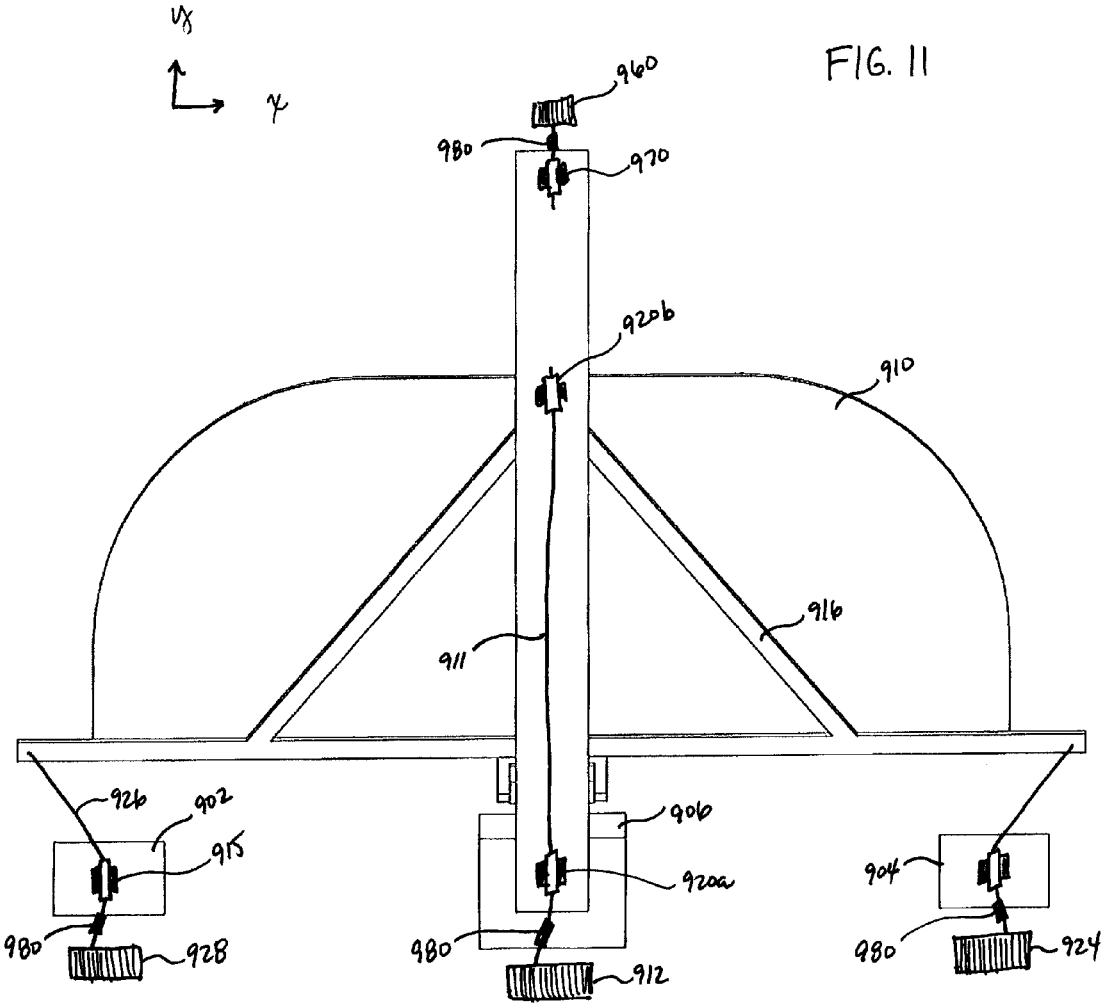
FIG. 11 is a top-down perspective of the embodiment shown in FIG. 9.

In yet still another embodiment, shown in FIGS. 9-11, the left and right vertical supports are positioned behind the motion base and a front vertical support is introduced. While many aspects of this embodiment are similar to the embodiments shown in FIG. 1, FIG. 5, and/or FIG. 6, elements have been uniquely numbered and described below to avoid confusion.

FIG. 9 is an isometric front view of an inverted motion base with suspended seating in accordance with another embodiment of the invention. FIG. 10 illustrates the alternate embodiment shown in FIG. 9 in a near midpoint elevation of the suspended seating in accordance with an embodiment of the invention. FIG. 11 is a top-down perspective of the embodiment shown in FIG. 9. In this exemplary embodiment, an inverted motion base 900 includes a left vertical support 902 and a right vertical support 904. The vertical supports 902, 904 are spaced apart from each other. Inverted motion base 900 further includes at least one rear vertical support 906 and at least one front vertical support 940. The rear vertical support 906 and front vertical support 940 are connected via a horizontal support connector 950. The vertical supports 902, 904 are in-line or approximately in-line with the at least one rear vertical support 906. Vertical supports 902, 904 could alternatively be referred to as right rear vertical support 904 and left rear vertical support 902. In this alternative description, the at least one rear vertical support 906 may be referred to as central rear vertical support 906. A carriage 908 is configured to travel vertically along a length of the rear support 906. Carriage 908 may be configured to resist lateral forces (i.e., left-right forces along the X axis). Such lateral resistance may be accomplished by, for example, the carriage 908 being set in a groove, rail, or cutout, or by strategically spaced limit blocks.

Carriage 908 is coupled to a slew bearing 990. Slew bearing 990 permits either transverse member 916 or a rigid support structure 910 (i.e., roof) to rotate about an axis through the center of the slew bearing 990 (e.g., an axis similar to axis 818 as shown by arrows 820 in FIG. 8). The roof 910, in addition to providing structural support to the inverted motion base 900, provides a false illusion of scale to the facility in which the inverted motion base 900 is installed. An articulated pivot 914 couples the slew bearing 990 to the roof 910 or transverse member 916. The articulated pivot 914 (shown in FIG. 10) permits roof 910 or transverse member 916 to tilt upward and downward (as similarly shown in the embodiment of FIG. 8 by arrows 824).

A transverse support member 916 comprises a primary transverse member 915 which may be coupled to articulated pivot 914 at the rear edge of the roof structure. The transverse support member 916 may comprise addition structure (e.g., angled supports 917*a* and 917*b* that form a type of "A" frame). These additional supports are connected to and positioned away from primary transverse member 915 such that, in one embodiment, the angled supports 917*a* and 917*b* meet at a midpoint 917*c* forward of the primary transverse member 915 and near the front of the roof structure 910. Transverse support member 916 may be configured to pivot with respect to slew bearing 990 about an axis that is perpendicular to a plane formed between the left and right vertical supports 902, 904. Transverse support member 916 may also be configured to pivot with respect to articulated pivot 914 about an axis that is parallel to the plane formed between the left and right vertical supports 902, 904.

A first cable 911 may be connected at a first end to transverse support member 916 at its forward most point 917*c* (near the front mid-point edge of the roof structure 910) or to the front mid-point of roof 910. A second end of the cable 911 may be wound about a first rotatable drum (or winch) 912. The first cable 911 in connection with first drum 912 are configured to raise and lower the front of roof 910.

A second cable 922 may be connected at a first end to a right end of the transverse support member 916. The cable's 922 second end may be wound about a second rotatable drum (or winch) 924. The second cable 922 in connection with second drum 924 may be configured to raise and lower the proximal end of the right end of transverse support member 916.

A third cable 926 may be connected at a first end to a left end of the transverse support member 916. The cable's 926 second end may be wound about a third rotatable drum (or winch) 928. The third cable 926 in connection with third drum 928 may be configured to raise and lower the left end of transverse support member 916.

In addition to respectively raising and lowering the right and left ends of traverse support member 916, the second and third cable, in combination, also raise and lower the carriage 908.

In one embodiment, the left, right, rear, and front vertical supports 902, 904, 906, and 940, respectively, are vertical columns. The vertical columns and horizontal support connector 950 may be made of steel or reinforced concrete, or equivalent load bearing material. In one embodiment, the left, right, and rear vertical supports 902, 904, 906, 940 and horizontal support connector 950 are fabricated from structural steel. In another embodiment, the left, right, and rear vertical supports 902, 904, 906, 940 are realized from the walls and the horizontal support connector 950 realized from the ceiling of a structure housing the inverted motion base 900.

According to the embodiment shown in FIGS. 9-11, the lifting mechanisms comprise floor mounted rotatable drums (winches), counterweights, and flagging sheaves. For example, according to the embodiment shown in FIG. 9, rotatable drum (winch) 912 is mounted on the ground (or floor), near the base of vertical support 906. A cable 911 runs from a forward point 917*c* of transverse support member 916 or to the front mid-point of roof 910 up to a pair of pulleys 920*a* and 920*b* (e.g., flagging sheaves) which are mounted atop the horizontal beam 950. Cable 911 passes through pulleys 920*a* and 920*b* and downward toward a counterweight 980. By balancing the weight of the inverted motion base 900 with the weight of counterweight 980, the horsepower of winch 912 can be reduced in comparison to that of a rotatable drum (winch) mounted atop vertical support 906, providing additional benefit to this embodiment.

Similarly, a set of rotatable drums (winches) 924, 928, pulleys 918, 915, and counter weights 980 are respectively coupled to right and left ends of the transverse support member 916.

In another embodiment, the rotatable drums (winches) 912, 928, 924 are mounted atop the rear, left, and right vertical supports 906, 902, 904. In an alternative embodiment, the rotatable drums (winches) 912, 928, 924 may be mounted within the facility ceiling.

The features of the seats 750, and seat supports 712, 714, 716, 718, and 719 are the same as described with respect to FIG. 7 above and will not be repeated here.

The structure as herein shown in FIGS. 9-11 and described accordingly, functions similar to and is capable of roll (left or right side of row at higher elevation than its respective opposite side) and heave (vertical excursions) motions similar to the other embodiments herein disclosed, but utilizing a different structural set-up.

In yet another optional embodiment, the front vertical support 940 may comprise a rotatable drum (winch) 960, pulley 970, counter weight 980, and cable 972, which are connected to the forward point 917*c* of transverse support member 916 or to the front mid-point of roof 910 to raise and lower the front of roof 910. This embodiment replaces the rotatable drum (winch) 912, pulley 920*a*/920*b*, counter weight 980, and cable 911. This embodiment also contemplates a rotatable drum (winch) 960 being located atop the front vertical support 940, without the pulley 970 and counter weight 980.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An inverted motion base, comprising:

left and right vertical supports, spaced apart from each other;

at least one rear vertical support;

a carriage to travel vertically along a length of the rear support and to resist lateral forces;

a first cable connected at a first end to the carriage, the first cable having a second end wound about a first rotatable drum, wherein the first cable in combination with the first rotatable drum raises and lowers the carriage;

a knuckle protruding from the carriage;

a transverse support member pivotably coupled to the knuckle;

left and right load carrying arms, each connected at a first end to a respective left and right ends of the transverse support member;

a second cable connected at a first end to a second end of the right load carrying arm, the second cable having a second end wound about a second rotatable drum, wherein the second cable in combination with the second rotatable drum raises and lowers the second end of the right load carrying arm;

a third cable connected at a first end to a second end of the left load carrying arm, the third cable having a second end wound about a third rotatable drum, wherein the third cable in combination with the third rotatable drum raises and lowers the second end of the left load carrying arm; and one or more rows of seats, each row of seats positioned between and suspended from the right and left load carrying arms, each row of seats being parallel to the other row of seats.

2. The inverted motion base of claim 1, wherein the left, right, and rear vertical supports are vertical columns.

3. The inverted motion base of claim 1, wherein the left, right, and rear vertical supports are fabricated from a load bearing material.

4. The inverted motion base of claim 1, wherein the left, right, and rear vertical supports are realized from the walls of a structure housing the inverted motion base.

5. The inverted motion base of claim 1, wherein the carriage rolls on wheels on a track fixed to the rear vertical support.

6. The inverted motion base of claim 5, wherein the carriage wheels are rotatably secured to the track to prevent lateral movement of the carriage.

7. The inverted motion base of claim 1, wherein each row of seats is suspended from the left and right load carrying arms by suspension arms of fixed length, and wherein the fixed length of each succeeding row, from the back of the load carrying arms to the front of the load carrying arms, is shorter than the preceding row.

8. The inverted motion base of claim 1, wherein, in a seat loading position, an angle of declination of the left and right load carrying arms measured relative to a horizontal plane containing the transverse member is less than or equal to an angle of inclination of the left and right load carrying arms measured relative to the horizontal plane containing the transverse member in a seat viewing position.

9. The inverted motion base of claim 1, wherein the transverse support member is pivotable with respect to the knuckle about an axis that is perpendicular to a plane formed between the left and right vertical supports.

10. The inverted motion base of claim 1, wherein the transverse support member is pivotable with respect to the knuckle about an axis that is parallel to the plane formed between the left and right vertical supports.

11. The inverted motion base of claim 1, wherein the first, second, and third rotatable drums are respectively mounted atop the rear, left, and right vertical supports.

12. The inverted motion base of claim 1, wherein the first, second, and third rotatable drums are respectively mounted approximate the base of the rear, right, and left vertical supports.

13. The inverted motion base of claim 12, further comprising:

a pulley mounted atop each of the rear, right, and left vertical supports over which the respective first, second, and third cables travel; and a counterweight positioned along each of the first, second, and third cables between the respective first, second, and third rotatable drums and the associated pulley.

14. The inverted motion base of claim 1, further comprising:

a roof coupled to one or more of the left load carrying arm, the right load carrying arm, the traverse support member, and the carriage.

15. A method of entertainment implemented with an inverted motion base including at least two rows of seats oriented such that each row is facing a first direction, a first row horizontally displaced in the first direction from a second row, the method comprising:

positioning the first row at a first height measured from a predetermined fixed point and the second row at a second height measured from the predetermined fixed point, wherein the second height is greater than the first height; and elevating the first and second rows to third and fourth heights, respectively, while maintaining the orientation of each row such that each faces the first direction, wherein the third height is greater than the second height and the fourth height is less than the third height, wherein the relative position of the first and second rows varies during the elevating step.

16. The method of claim 15, wherein the first and second rows are elevated along non-linear paths.

17. The method of claim 15, further comprising:

maintaining a given horizontal separation between the first and second rows while simultaneously, at the same rate, moving the first and second rows vertically.

18. The method of claim 15, further comprising:

producing left or right roll sensation for all seats in the first and second rows by maintaining a given horizontal separation between the first and second rows while simultaneously raising or lowering at least one side of at least one of the first and second rows.

19. An inverted motion base, comprising:

left and right rear vertical supports, spaced apart from each other;

a central rear vertical support;

a front vertical support;

a horizontal support connector coupling the central rear vertical support with the front vertical support;

a carriage to travel vertically along a length of the central rear vertical support and to resist lateral forces;

a slew bearing protruding from the carriage;

a transverse support member pivotably coupled to the slew bearing via an articulated pivot element;

a roof coupled to the transverse support member;

one or more rows of seats, each row of seats suspended from the roof, each row of seats being parallel to the other row of seats;

a first cable connected at a first end to a forward edge mid-point of the roof, the first cable having a second end wound about a first rotatable drum, wherein the first cable in combination with the first rotatable drum raises and lowers the front of the roof;

a second cable connected at a first end to a right end of the transverse support member, the second cable having a second end wound about a second rotatable drum, wherein the second cable in combination with the second rotatable drum raises and lowers the right end of the transverse support member; and a third cable connected at a first end to a left end of the transverse support member, the third cable having a second end wound about a third rotatable drum, wherein the third cable in combination with the third rotatable drum raises and lowers the left end of the transverse support member, wherein the combination of the second and third cable raise and lower the carriage.

20. The inverted motion base of claim 19, wherein the first, second, and third rotatable drums are respectively mounted approximate the base of the central rear, right rear, and left rear vertical supports, and wherein the inverted motion base further comprises:

one or more pulleys mounted atop each of the horizontal connector and the right and left vertical supports over which the respective first, second, and third cables travel; and a counterweight positioned along each of the first, second, and third cables between the respective first, second, and third rotatable drums and the associated pulleys.

* * * * *